US006042695A

United States Patent [19]

Ishino

[11] Patent Number: 6,042,695

[45] Date of Patent: Mar. 28, 2000

[54] SHOE PRESS BELT WITH LATERAL VARIATIONS IN HARDNESS

[75] Inventor: Atsushi Ishino, Matsudo, Japan

[73] Assignee: Ichikawa Co., Ltd., Tokyo, Japan

[21] Appl. No.: 09/024,542

[22] Filed: Feb. 17, 1998

[30] Foreign Application Priority Data

Apr. 24, 1997 [JP] Japan ..... 9-121733

[51] Int. Cl.[7] ..... D21F 3/00

[52] U.S. Cl. ..... 162/358.4; 428/217; 428/192

[58] Field of Search ..... 428/217, 192; 474/201, 268; 162/358.4, 901; 118/257

[56] References Cited

U.S. PATENT DOCUMENTS

| | | | |
|---|---|---|---|
| 290,147 | 12/1883 | Tullis | 474/269 |
| 4,229,254 | 10/1980 | Gill | 162/358 |
| 4,330,023 | 5/1982 | Cronin | 162/358 |
| 4,552,620 | 11/1985 | Adams | 162/358 |
| 4,877,472 | 10/1989 | Rodal | 156/184 |
| 4,908,103 | 3/1990 | Cronin et al. | 162/358 |
| 4,944,844 | 7/1990 | Marcinko | 162/205 |
| 4,975,152 | 12/1990 | Filzen et al. | 162/358 |
| 4,978,428 | 12/1990 | Cronin et al. | 162/358 |
| 5,175,037 | 12/1992 | Merkens et al. | 428/57 |
| 5,178,937 | 1/1993 | Janssen et al. | 428/222 |
| 5,180,345 | 1/1993 | Van Der Zande | 474/201 |
| 5,208,087 | 5/1993 | Stigberg | 428/60 |
| 5,422,165 | 6/1995 | Arnold | 428/192 |
| 5,766,421 | 6/1998 | Aufrecht | 162/358.4 |
| 5,836,242 | 11/1998 | Aberg | 100/327 |

FOREIGN PATENT DOCUMENTS

| | | | |
|---|---|---|---|
| 4401580 | 6/1994 | Germany | 162/358.4 |

*Primary Examiner*—Ellis Robinson
*Assistant Examiner*—Laura L. Lee
*Attorney, Agent, or Firm*—Quarles & Brady LLP

[57] ABSTRACT

A shoe press belt has both sides coated with a resin layer and one or both layers with side edge portions softer than the middle portion of the resin layer. The hardness of the side edge portions may first decrease stepwise laterally outwardly from the middle portion to a section which overlies the edge of the shoe, and then increase stepwise laterally outwardly to the edge of the belt. A first stepwise reduction in hardness may begin laterally inward of the edge of the wet paper sheet and extend laterally outwardly to the edge of the wet paper sheet, where a second stepwise reduction begins that extends laterally outwardly beyond the edge of the shoe. Laterally outwardly of the second reduction, a stepwise increase in hardness extends to the edge of the belt. Alternatively, each side edge portion may be of a single hardness, less than the hardness of the middle portion, and each side edge portion overlies one of the side edges of the shoe.

6 Claims, 2 Drawing Sheets

SHOE PRESS BELT WITH LATERAL VARIATIONS IN HARDNESS

FIELD OF THE INVENTION

The present invention relates to a shoe press belt and, more particularly, to a shoe press belt for a closed shoe press.

DISCUSSION OF THE PRIOR ART

Generally, a shoe press belt of the type to which the present invention relates is formed in the shape of an endless belt. The shoe press belt supporting felt and wet paper sheet runs through a nip between a press roller and a shoe, and the wet paper sheet is compressed between the press roller and the shoe to squeeze water out of the wet paper sheet.

Most conventional shoe press belts have a foundation layer having only one resin coated surface, which is the surface to be brought into contact with the shoe. Recently developed shoe press belts have a foundation layer having both surfaces coated with a resin layer, i.e., the surface on which the felt is supported as well as the other surface, to improve the abrasion resistance and water draining performance. In most of such recently developed shoe press belts, the resin layer coating the surface to be contiguous with felt is provided with grooves or bottomed holes to provide the shoe press belt with a sufficient capacity to hold water drained from the wet paper sheet.

In a shoe press belt having a foundation layer with opposite surfaces coated with a resin layer, the resin layer which is brought into contact with the shoe is important to provide the shoe press belt with resistance against abrasion by the shoe. The resin layer which is brought into contact with the felt is important to provide the shoe press belt with resistance against abrasion by the felt and resistance against pressing pressure which crushes the grooves and holes. The resin layers must be formed of a resin having a high hardness to enhance such resistance. However, since the shoe press belt is subjected to a sharp bending action during running, particularly during running through the press, the hardness of the resin forming the resin layers must be relatively low in order to secure sufficient flexing fatigue strength.

Thus, the shoe press belt must have two requisite characteristics: abrasion resistance and flexing fatigue strength. Increasing the hardness of the resin exercises a favorable effect on abrasion resistance and an unfavorable effect on flexing fatigue strength, and reducing the hardness has the opposite effect. Thus, it is difficult to improve the two requisite characteristics simultaneously. Therefore, the hardness of the resin is determined so that both of the two requisite characteristics of the shoe press belt are satisfied to some extent.

Since the hardness of the resin is determined so as to satisfy both of the two requisite characteristics to some extent, the two characteristics are each compromised, and the belt is readily affected by variations in the load on the belt during a shoe-pressing operation, even if the load varies only slightly.

If the opposite side edge portions of the belt to be brought into contact with the side edges of the shoe are subjected to a high load, i.e., a sharp bending distortion, cracks attributable to flexing fatigue develop earlier in the opposite side edge portions of the belt than in the middle portion of the belt, causing lubricating oil to ooze through the cracks on the surface and the resin layer to peel off starting from the cracks, which greatly reduces the service life of the shoe press belt.

Therefore, avoiding the development of cracks in the resin layer and improving the abrasion resistance of the resin layer have been contradictory to one another in conventional shoe press belts; that is, abrasion resistance is reduced if a resin having a relatively low hardness is used to give priority to avoiding cracking and cracks develop in the resin layer if a resin having a relatively high hardness is used to improve abrasion resistance.

Accordingly, it is an object of the present invention to provide a shoe press belt capable of satisfying the foregoing contradictory objectives to some extent and having side edge portions corresponding to the side edges of the shoe satisfactorily resistant to cracking and abrasion.

SUMMARY OF THE INVENTION

With the foregoing in view, the present invention provides a shoe press belt having a foundation layer, a first resin layer formed on one surface of the foundation layer, and a second resin layer formed on the other surface of the foundation layer. The hardness of the first or the second resin layer or each of the first and the second resin layers decreases from a middle portion with respect to the width of the shoe press belt toward the side edge portions of the same. The shoe press belt secures necessary abrasion resistance by the middle portion thereof, and secures improved flexing fatigue strength which suppresses cracking by the side edge portions thereof.

According to another aspect of the invention, each of the side edge portions of the resin layers having a relatively low hardness includes a portion corresponding to a side edge of the shoe. The portions of the resin layers corresponding to the side edges of the shoe suppress cracking.

In another aspect of the invention, the hardness of each of the side edge portions of the resin layers decreases stepwise from a side near to the middle portion of the belt toward the portion corresponding to the side edges of the belt. The hardness of the resin layers of the shoe press belt does not change sharply with distance from the middle of the shoe press belt.

In another aspect, the hardness of each of the side edge portions decreases stepwise from a side near to the middle of the belt toward a portion corresponding to the side edge of the shoe, and increases stepwise from the portion corresponding to the side edge of the shoe toward the side edge corresponding to the side edge of the belt. Thus, the crack resistance of the side edge portions corresponding to the side edges of the shoe, in particular, is enhanced and the side edge portions of the belt are able to secure dimensional stability.

DETAILED DESCRIPTION OF THE PREFERRED EMBODIMENTS

Preferred embodiments of the present invention will be described hereinafter with reference to the accompanying drawings.

Figure 1:
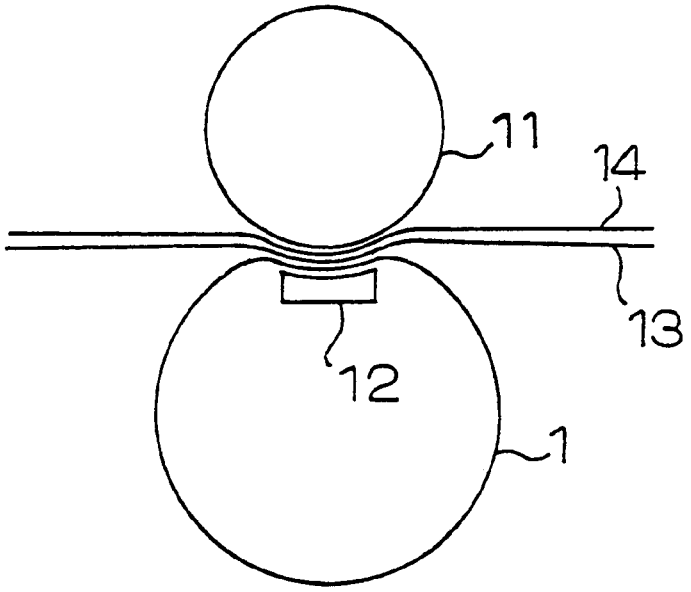
FIG. 1 is a schematic sectional view of a shoe press machine.
Figure 2:
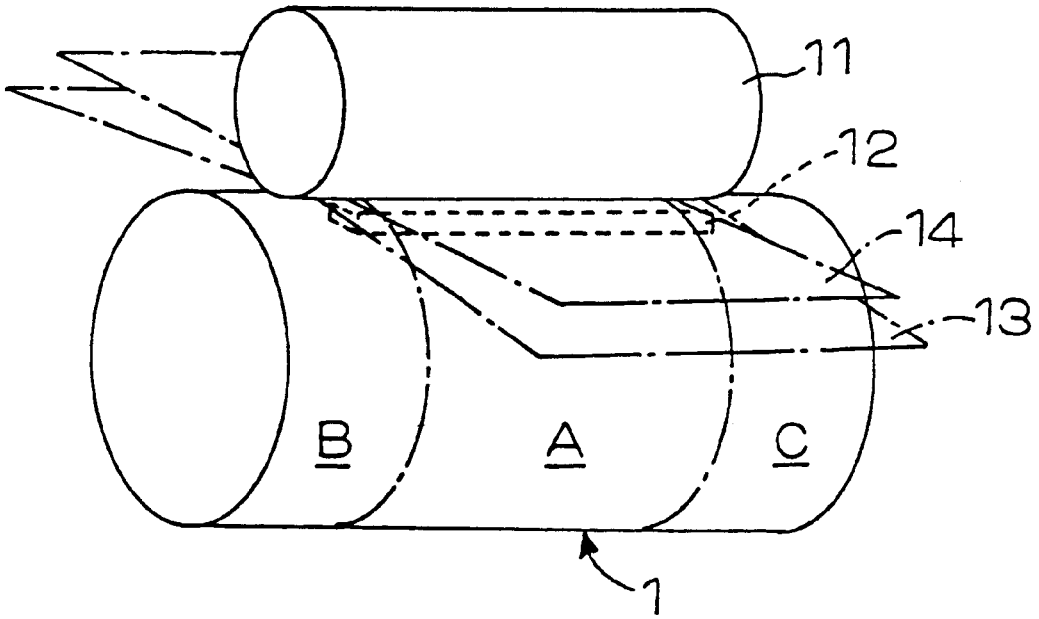
FIG. 2 is a schematic perspective view of the shoe press machine.

Referring to FIGS. 1 and 2, a shoe press belt 1 in a preferred embodiment according to the present invention supporting felt 13 and a wet paper sheet 14 runs through a nip line between a press roller 11 and a shoe 12 to enable the press roller 11 to apply a pressure to the wet paper sheet 14 compressed between the press roller 11 and the shoe 12.

Figure 3:
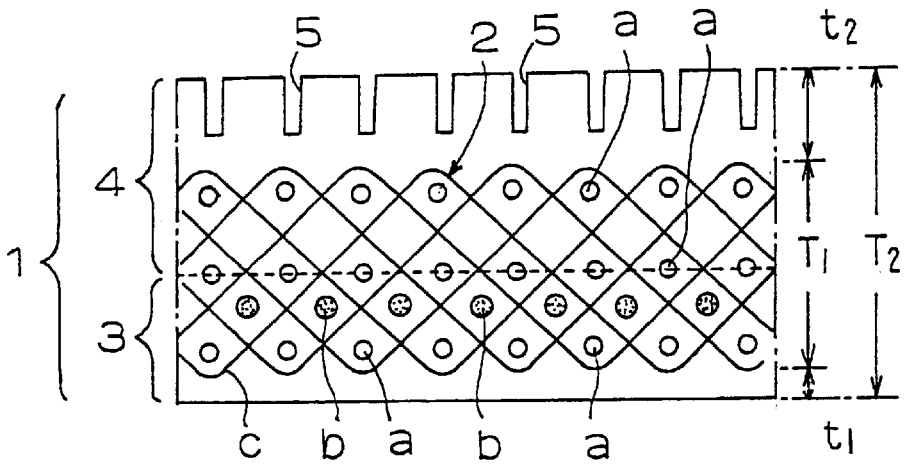
FIG. 3 is an enlarged typical sectional view of a shoe press belt in a preferred embodiment according to the invention.

As shown in FIG. 3, the shoe press belt 1 consists of a foundation layer 2 of a thickness $T_1$, a first resin layer 3 coating a first surface of the foundation layer 2 facing the shoe 12, and a second resin layer 4 coating a second surface of the foundation layer facing the felt. The foundation layer 2 is of a warp backed triple weave consisting of warps a, filling yarns b and weft yarns c. The warp yarns a are PET (polyethylene terephthalate) monofilaments, the filling yarns b are PET multi filament yarns, and the weft yarns c are PET monofilaments. The first resin layer 3 is finished by grinding in an apparent thickness $t_1$, i.e., the thickness of a portion of the first resin layer 3 between the first surface of the foundation layer 2 and the surface of the first resin layer 3, and the second resin layer 4 is finished by grinding in an apparent thickness $t_2$, i.e., the thickness of a portion of the second resin layer 4 between the second surface of the foundation layer 2 and the surface of the second resin layer 4 to form the shoe press belt 1 in a thickness $T_2$.

Figure 4:
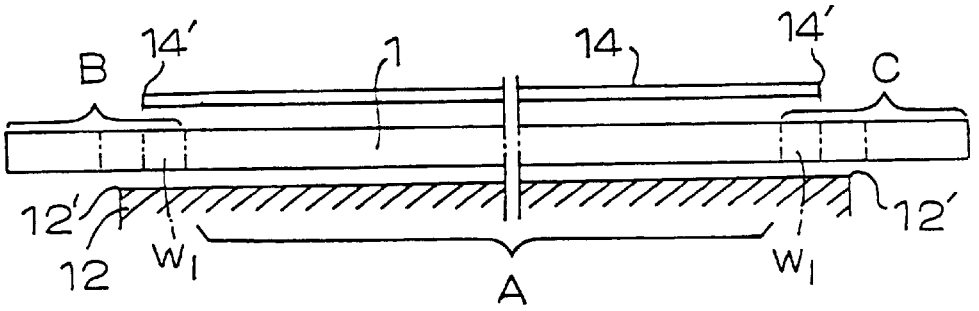
FIG. 4 is an enlarged sectional view of opposite side edge portions of the shoe press belt of the invention.

As shown in FIG. 4, each of the first resin layer 3 and the second resin layer 4 has a middle portion A with respect to the width of the shoe press belt 1 formed of a resin having a relatively high hardness. More specifically, it is preferable to form the middle portion A of the first resin layer 3 on the side of the shoe 12 of a resin having a hardness in the range of 85° to 93° (Japanese Industrial Standard (JIS)-A), and to form the middle portion A of the second resin layer 4 on the side of the felt of a resin having a hardness in the range of 90° to 98° (JIS-A).

Laterally opposite side edge portions B and C of each of the first resin layer 3 and the second resin layer 4 are formed of a resin having a hardness lower than that of the resin forming the middle portion A by 1° to 5°. More specifically, it is preferable that the edge portions B and C of the first resin layer 3 on the side of the shoe 12 is formed of a resin having a hardness in the range of 80° to 88° (JIS-A), and the edge portions B and C of the second resin layer 4 on the side of the felt is formed of a resin having a hardness in the range of 85° to 93° (JIS-A).

Figure 5:
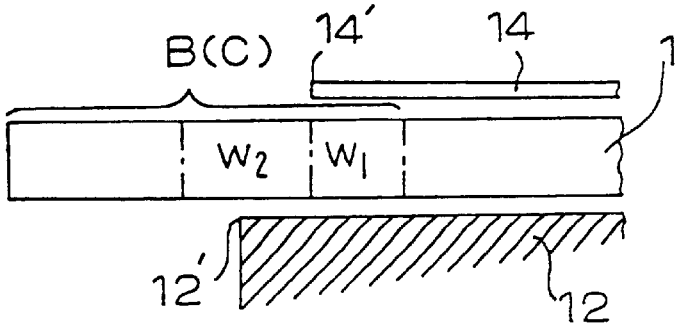
FIG. 5 is an enlarged sectional view of a portion of the shoe press belt of the invention corresponding to a side edge of a shoe.

Each of the side edge portions B and C of the resin layers formed of a resin having a relatively low hardness and forming the surfaces of the side edge portions B and C of the belt 1 includes at least a section $W_2$ corresponding to, i.e., directly over, a side edge 12' of the shoe 12. Each of the side edge portions B and C of the resin layers forming the surfaces of the side edge portions of the belt 1 may include section $W_1$, laterally inward of the corresponding section $W_2$, of a fixed width of about 5 cm corresponding to, i.e., directly under, a side edge portion of the wet paper sheet 14 having a side edge 14' as shown in FIGS. 4 and 5.

Each of the side edge portions B and C of the resin layers 3 and 4 is formed of the resin having a relatively low hardness to avoid the development of cracks in the resin layers 3 and 4. Therefore, the side edge portions of the resin layers 3 and 4 may be formed of a resin of a composition different from that of the resin forming the middle portions of the resin layers 3 and 4 corresponding to the middle portion A of the belt 1. A polyurethane resin of a relatively low hardness, for the side edge portions, obtained by a prepolymer method may be prepared by:

- a first method which uses the same isocyanate and the same curing agent as the middle portions and a prepolymer having a relatively larger molecular weight; or
- a second method which uses different types of isocyanate and curing agent as well as a different molecular weight of the prepolymer than the middle portions.

A requirement of the shoe press belt 1 that the portion of the resin layer corresponding to the middle portion A of the belt 1 and the side edge portions B and C of the resin layer have different hardnesses, respectively, can be satisfied by forming the middle and the side edge portions of the resin layer of resins respectively having different thermosoftening properties if the shoe press belt 1 is to be used at a relatively high working temperature of 50° C. or above. For example, if the middle portion of the resin layer corresponding to the middle portion A of the belt 1 is formed of a heat-resistant resin, such as a urea resin or the like, and the side edge portions B and C of the same are formed of a polyurethane resin or the like, the hardness of the middle portion of the resin layer and that of the side edge portions of the resin layer are substantially equal to each other or the latter is higher than the former at a room temperature, and the hardness of the side edge portions B and C of the resin layer is lower than that of the middle portion of the same corresponding to the middle portion A of the belt 1 when the belt 1 is used at the working temperature.

Since the shoe press belt 1 is wet with water during use, the middle portion of the resin layer corresponding to the middle portion A of the belt 1 and the side edge portions B and C of the resin layer may be made to differ in hardness from each other during use by, for example, curing the middle portion and the side edge portions of the resin layer at different temperatures, respectively, or forming the resin layer so that the middle portion and the side edge portions of the resin layer have different water absorptions, respectively.

It is preferable to decrease stepwise the hardness of the side edge portions B and C of a relatively low hardness of the resin film from a laterally inward side (near to the middle portion) toward the side edges of the belt 1 to avoid the sharp change of hardness the boundaries between the middle portion A and the side edge portions B and C of the resin film respectively corresponding to the middle portion and the side edge portions of the belt 1.

The hardness of each of the side edge portions B and C of a relatively low hardness of the resin film may be decreased stepwise laterally outwardly from the laterally inward side near to the middle of the belt 1 toward the section $W_2$ corresponding to the side edge 12' of the shoe 12 and may be increased stepwise laterally outwardly from the section $W_2$ corresponding to the side edge 12' of the shoe 12 toward the side edge of the belt 1 as shown in FIG. 5. Thus, the section $W_2$ corresponding to the side edge 12' of the shoe 12 and most likely to be cracked is formed of the lowest hardness resin.

Water holding means 5, such as grooves or bottomed holes, are formed in the surface of the second resin layer 4 to be in contact with the felt to enhance the draining efficiency of the shoe press belt 1 by holding water squeezed out of the wet paper sheet 14.

The belt 1 of the present invention is driven by the press roller 11 through the wet paper sheet 14 and the felt 13. The width of the belt 1 of the present invention is greater than that of the shoe 12. Therefore, end portions of the belt 1 extending outside the opposite ends of the shoe 12 are not subjected to pressure, and a middle portion of the belt 1 corresponding to the shoe 12 is subjected to pressure. Therefore, a driving force acts on the middle portion of the belt 1 and the end portions are dragged by the middle portion; consequently, a diagonal stress is induced in the boundaries between the middle portion and the end portions of the belt 1.

Since the middle portions with respect to the width of the belt 1 of the first resin layer 3 formed on the first surface of the foundation layer 2 and the second resin layer 4 formed on the second surface of the foundation layer 2 corresponding to the middle portion A of the belt 1 are formed of the resin having a relatively high hardness, and the side edge portions B and C of the first resin layer 3 and the second resin layer 4 are formed of the resin of a relatively low hardness lower than that of the middle portions of the resin layers 3 and 4 corresponding to the middle portion A of the belt 1 by 1° to 5° (JIS-A), cracks are not formed easily by the foregoing stress.

EXAMPLE

A polyester fabric of 2.5 mm in thickness $T_1$ of a warp backed triple weave consisting of 0.4 mm diameter PET monofilament yarns as warp yarns, PET multi filament yarns as filling yarns, and 0.4 mm diameter PET monofilament yarns as weft yarns was used as a foundation layer 2. A middle region A of a first surface of the foundation layer 2, i.e., a surface on the side of the shoe, was coated with a resin layer of a thermosetting urethane resin (mixture of a prepolymer prepared by mixing 40 parts Adiprene L167 and 60 parts Adiprene L100 available from Uniroyal Chemical Co., and Cuamine MT available from Ihara Chemical Industry Co., Ltd. as a hardening agent) having a hardness of 92°.

Then, each of side edge regions B and C of the first surface of the foundation layer 2 was coated with a resin layer of a thermosetting urethane resin (mixture of Adiprene L100 as a prepolymer and the Cuamine MT as a hardening agent) having a hardness of 90° to form a first resin layer 3. Then, the first resin layer 3 was ground to an apparent thickness $t_1$ of 0.9 mm.

A middle region A of a second surface of the foundation layer 2, i.e., the surface on the side of the felt, was coated with a resin layer of a thermosetting urethane resin (mixture of Adiprene L167 available from Uniroyal Chemical Co. as a prepolymer, and Cuamine MT available from Ihara Chemical Industry Co., Ltd. as a hardening agent) having a hardness of 95°. Then, each of side edge regions B and C of the second surface of the foundation layer 2 was coated with a resin layer of a thermosetting urethane resin (mixture of a prepolymer prepared by mixing 40 parts Adiprene L167 and 60 parts Adiprene L100, and Cuamine MT as a hardening agent) having a hardness of 92° to form a second resin layer 4.

Then, the second resin layer 4 was ground to an apparent thickness $t_2$ of 2.1 mm to construct a structure having an overall thickness $T_2$ of 5.5 mm and consisting of the foundation layer 2, the first resin layer 3 and the second resin layer 4. Then, grooves 5 of 0.8 mm in width and 1.0 mm in depth were formed at pitches of 3.3 mm in the surface of the second resin layer 4 to complete a shoe press belt 1 of 4.49 m in length and 170 cm in width.

Comparative Example

The same foundation layer 2 as used for forming the shoe press belt in the above Example was used. A first resin layer 3 of 92° in hardness of a thermosetting urethane resin (mixture of Adiprene L167 (Uniroyal Chemical Co.) as a prepolymer, and Cuamine MT (Ihara Chemical Industry Co., Ltd.) as a hardening agent was formed over a middle region and opposite side edge regions B and C of a first surface of the foundation layer 2 on the side of the shoe, a second resin layer 4 of 95° in hardness of a thermosetting urethane resin (mixture of Adiprene L167 (Uniroyal Chemical Co.) as a prepolymer, and Cuamine MT (Ihara Chemical Industry Co., Ltd.) as a hardening agent) was formed over a middle region and opposite side edge regions B and C of a second surface of the foundation layer 2 on the side of the felt, and the same grooves 5 as formed in the second resin surface 4 of the shoe press belt in the Example were formed in the second resin layer 4 to complete a shoe press belt of dimensions that are the same as those of the shoe press belt of the first Example.

The shoe press belts in the above Example and Comparative Example were tested on a testing machine. Whereas cracks developed in portions of the shoe press belt of the Comparative Example corresponding to the side edges of the shoe after a test time of 250 hr, cracks did not develop in the shoe press belt in the Example after a test time of 600 hr.

As is apparent from the foregoing description, the shoe press belt of the present invention comprises a foundation layer, a first resin layer formed on the inner surface of the foundation layer, and a second resin layer formed on the outer surface of the foundation layer, with the hardness of the first or the second resin layer or each of the first and the second resin layers decreasing from the middle portion with respect to the width of the shoe press belt toward the side edge portions of the same. Thus, the middle portion of the belt provides abrasion resistance and resistance to deformation by pressure, the opposite side portions are resistant to cracking, and the belt can be used for an extended period of working time.

Each of the side edge portions of the resin layers having a relatively low hardness preferably includes a portion corresponding to a side edge of the shoe. Therefore, the resin layers of the shoe press belt are highly resistant to stress induced therein.

In addition, the hardness of each of the side edge portions of the resin layers may decrease stepwise from a side near to the middle of the belt toward the portion corresponding to the side edge of the belt. Therefore, the hardness of the resin layers does not change sharply.

Moreover, the hardness of each of the side edge portions of the resin layers may decrease stepwise from a side near to the middle of the belt toward a portion corresponding to the side edge of the shoe, and additionally increase stepwise from the portion corresponding to the side edge of the shoe toward the side edge corresponding to the side edge of the belt. Thus, the crack resistance of the side edge portions corresponding to the side edges of the shoe is enhanced particularly and the side edge portions of the belt are able to secure dimensional stability.

I claim:

1. A shoe press belt having improved flexing fatigue strength and enhanced crack resistance, comprising:

a foundation layer having opposite surfaces and laterally spaced opposite side edges;

a first resin layer of resin material formed on one of said surfaces of said foundation layer; and a second resin layer of resin material formed on the other of said surfaces of said foundation layer;

wherein at least one of said resin layers has laterally spaced side edge portions and a middle portion between said side edge portions; and wherein the hardness of said resin material of said at least one resin layer decreases from said middle portion to said side edge portions.

2. A shoe press belt as claimed in claim 1, wherein the hardness of each of said side edge portions of said at least one resin layer decreases incrementally laterally outwardly from a laterally inward side of each of said side edge portions.

3. In combination a shoe and a shoe press belt having improved flexing fatigue strength and enhanced crack resistance wherein said belt comprises:

a foundation layer having opposite surfaces and laterally spaced opposite side edges;

a first resin layer of resin material formed on one of said surfaces of said foundation layer; and a second resin layer of resin material formed on the other of said surfaces of said foundation layer;

wherein at least one of said resin layers has laterally spaced side edge portions and a middle portion between said side edge portions;

wherein the hardness of said resin material of said at least one resin layer decreases from said middle portion to said side edge portion; and wherein the hardness of said side edge portions of said at least one resin layer decreases incrementally laterally outwardly from a laterally inward side of each said side edge portion toward a section of each said side edge portion corresponding to a side edge of said shoe, and increases incrementally laterally outwardly from each said section corresponding to said side edge of said shoe toward a section corresponding to a side edge of said belt—in order to secure dimensional stability.

4. In combination a shoe and a shoe press belt having improved flexing fatigue strength and enhanced crack resistance wherein said belt comprises:

a foundation layer having opposite surfaces and laterally spaced opposite side edges;

a first resin layer of resin material formed on one of said surfaces of said foundation layer; and a second resin layer of resin material formed on the other of said surfaces of said foundation layer;

wherein at least one of said resin layers has laterally spaced side edge portions and a middle portion between said side edge portions;

wherein the hardness of said resin material of said at least one resin layer decreases from said middle portion to said side edge portion; and wherein each of said side edge portions of said belt coated with said resin material of a relatively low hardness includes a section corresponding to an edge of said shoe.

5. A shoe press belt as claimed in claim 4, wherein the hardness of each of said side edge portions of said at least one resin layer decreases incrementally laterally outwardly from a laterally inward side of each of said side edge portions.

6. A shoe press belt as claimed in claim 4, wherein the hardness of each of said side edge portions of said at least one resin layer decreases incrementally laterally outwardly from a laterally inward side of each of said side edge portions toward a section of each of said side edge portions corresponding to a side edge of said shoe, and increases incrementally laterally outwardly from each said section corresponding to said side edge of said shoe toward a section corresponding to a side edge of said belt in order to secure dimensional stability.

* * * * *